United States Patent [19]

Cote et al.

[11] Patent Number: 5,022,670

[45] Date of Patent: Jun. 11, 1991

[54] SEPARABLE CREEPER HAVING A NON-PLANAR SUPPORT SURFACE

[76] Inventors: James L. Cote, 645 Monte Pinet, RR 3 St., Calixte, P.Q. Jokizo, Canada; Roy E. Bowling, 1355 Harlan St., Lakewood, Colo. 80214

[21] Appl. No.: 456,443

[22] Filed: Dec. 15, 1989

Related U.S. Application Data

[63] Continuation-in-part of Ser. No. 209,180, Jun. 20, 1988, abandoned.

[51] Int. Cl.[5] ..... B25H 5/00

[52] U.S. Cl. ..... 280/32.6; 280/47.16; 403/379

[58] Field of Search ..... 280/32.5, 32.6, 32.7, 280/28.5, 79.11, 11.22, 47.16, 47.18, 47.2, 47.24; 5/417, 419; 108/901, 902; 403/265, 379

[56] References Cited

U.S. PATENT DOCUMENTS

| | | | |
|---|---|---|---|
| 68,811 | 9/1867 | Van Doren | 280/32 |
| 518,094 | 4/1894 | Crouch | 280/32 |
| 653,942 | 7/1900 | Willis et al. | 280/32 |
| 687,284 | 11/1901 | Stebbins | 280/47.16 |
| 849,527 | 4/1907 | Bowers | 280/47.16 |
| 903,890 | 11/1908 | Scherping | 280/32 |
| 1,098,262 | 5/1914 | Hollingshead | 280/32.6 |
| 1,368,716 | 2/1921 | Gontrum et al. | 280/32.6 |
| 1,618,257 | 2/1927 | Young | 280/32 |
| 1,623,298 | 4/1927 | Bell | 280/47.16 |
| 1,658,893 | 2/1928 | Gladding | 280/79.11 |
| 2,466,173 | 4/1949 | Klinker | 280/32 |
| 3,558,152 | 1/1971 | Miles et al. | 280/47.16 |
| 3,918,733 | 11/1975 | Macho et al. | 380/79.11 X |
| 4,060,252 | 11/1977 | Mowery | 280/79.11 |
| 4,564,216 | 1/1986 | Kinyon et al. | 280/32.6 X |

*Primary Examiner*—Andres Kashnikow
*Assistant Examiner*—Brian L. Johnson
*Attorney, Agent, or Firm*—Alvin S. Blum

[57] ABSTRACT

A long, narrow, rigid panel supports a row of wheels beneath each long edge. The wheels are spaced sufficiently close together and are small enough to roll over the usual size joists and trusses and to span at least two so that a person lying on the panel can propel by arms or legs over an irregular surface such as in the confined space of an unfinished attic with a low roof. The device separates into two parts for ease of storage and access to confined spaces. The two parts join at an angle of less than 180 degrees. Since the two joined parts do not lie in a common plane, the user can balance over, and be supported by, the four wheels adjacent the joint when on a flat surface. This makes it easier to pivot and change direction of movement than when all the wheels are in contact with a flat surface. Optional plow-like devices can be attached to the front end to move protruding insulation out of the way.

6 Claims, 3 Drawing Sheets

SEPARABLE CREEPER HAVING A NON-PLANAR SUPPORT SURFACE

This application is a continuation-in-part of copending patent application Ser. No. 07/209,180 filed 6/20/88, now abandoned.

BACKGROUND OF THE INVENTION

This invention relates to rolling work platforms and more particularly to a rolling work platform to support a worker in horizontal position while rolling in a confined attic space, a site having a very irregular surface, or a flat smooth surface.

It is often necessary for workers to work in the space between ceiling and roof for installation and repair of roof, insulation, air conditioning, electric wiring, ceiling and attic fans and the like. When a finished attic with a floor and standing space is present, the worker can move about and perform his duties without difficulty. However, modern construction economics generally dictates a low attic space with the roof supported by trusses that make movement in the attic space very difficult. There is generally no flooring over the trusses and fiberglass insulation is installed between trusses that are generally about two feet apart with a maximum crawl height of about four feet. The space is so low that one cannot stand and the space between trusses is not only uncomfortable because of the insulation, but one avoids stepping between the trusses for fear of falling through the ceiling. Carrying heavy items under these conditions is especially difficult. A rolling platform long enough to serve the above purpose is awkward to store and to introduce into the confined space through some of the small access ports provided. Mechanic's creepers of the prior art provide a work platform on which a worker reclines and that he can roll around on while working beneath a structure, such as a vehicle. These ordinarily have canted wheels at each of four corners. Such a creeper cannot be used in an unfinished attic, as the wheels are trapped between trusses. Nevertheless, it would be useful if a device that can span trusses could also serve as a mechanic's creeper for rolling easily in any direction on a smooth flat surface. Those devices with many closely spaced wheels all in one plane cannot pivot and change direction easily on a flat surface because of the lateral forces on the many wheels.

An additional problem encountered when working in attic spaces is that loose insulation as much as a foot deep may cover the surface to be traversed.

SUMMARY OF THE INVENTION

It is accordingly an object of the invention to provide a platform on which a worker can recline and move himself and objects about in the reclining position over roof trusses in an attic or in similar work situations where it is necessary to roll about on an irregular surface. It is another object of the invention to provide such a platform that can be reduced in its longest dimension for ease of storage and entry into confined spaces. It is yet another object to provide such a platform that can also readily pivot and roll about on a smooth, flat surface. It is yet another object to provide such a platform with removable means for deflecting loose insulation and the like from its path.

The invention comprises a long narrow platform to support the reclining person. A row of closely spaced wheels is located below each of the two long edges of the platform. The wheels extend below the platform and are spaced together close enough that the upper edge of the roof truss will bear against at least two wheels, and the platform is long enough to span at least two roof trusses, to ensure easy rolling across the trusses. The device separates into two rejoinable portions for ease of handling. When joined, the two portions are not in a common plane, forming an angle of less than 180 degrees at the top. Consequently, the four wheels adjacent the joining line will be the only wheels in contact with a flat surface when the user balances over the joint. The platform pivots easily under these conditions. A deflector that acts like a plow in moving aside loose insulation may be provided for removably attaching to the forward end of the platform.

These and other objects, advantages and details of structure will become more apparent when the detailed description is studied in conjunction with the appended illustrations.

DETAILED DESCRIPTION OF PREFERRED EMBODIMENTS

Figure 1:
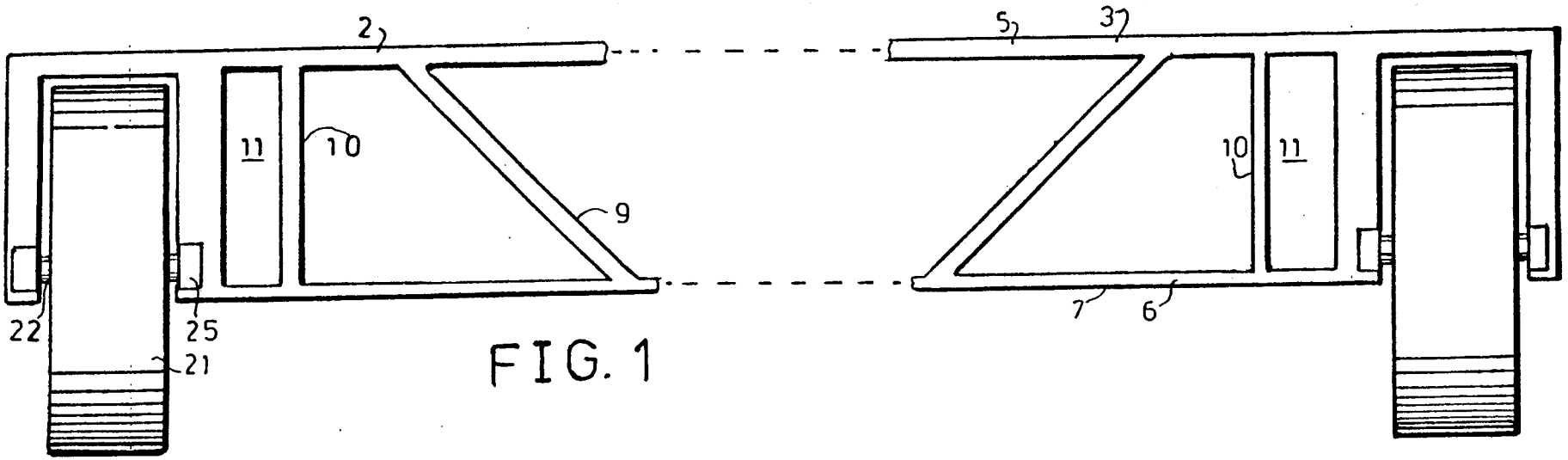
FIG. 1 is an end elevation view of the creeper.

Referring now first to FIGS. 1–4, a creeper 1 of the invention comprises a panel 2 having a substantially flat upper surface 3 to comfortably support the torso of the user when lying flat. The panel will have a length of at least fifty inches to ensure spanning at least two trusses or joists at any time. In order to facilitate maneuverability in the confined spaces and passage through small ceiling access ports, the width is limited to 12 inches. To further facilitate passage through access ports and reduce shipping and storage problems, the length of the creeper may be halved by hinging in the middle or by separating at the mid-point 4 as shown here in a preferred embodiment that maintains structural rigidity when joined, with an angle of 175 degrees between the two halves 14 and 15 maintained by the bars 12 that are bent to that angle. This ensures that the wheels 21 adjacent to joint 4 will be the only wheels in contact with a flat floor when the user balances over the joint for ease of rotation.

Figure 2:
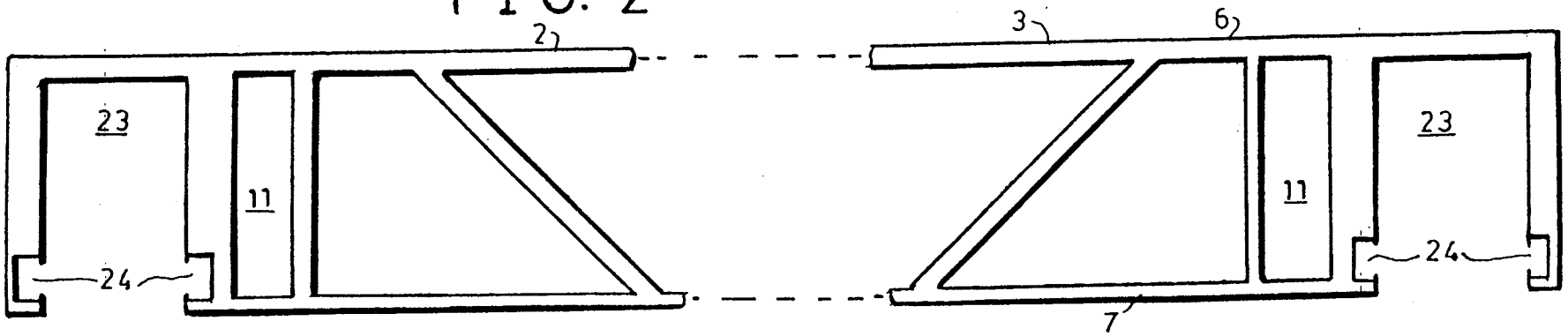
FIG. 2 is an end elevation view of the creeper without wheels.
Figure 3:
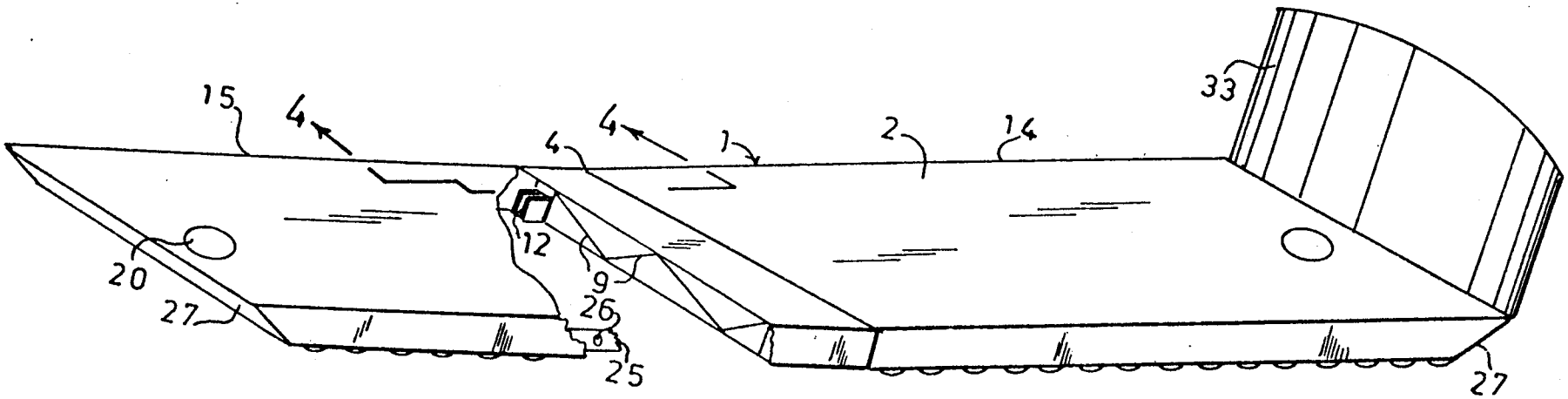
FIG. 3 is a perspective view of the creeper.

The panel 2 is formed from a profile extrusion 6, shown in FIG. 2 with a center portion removed for illustration, of aluminum alloy or rigid plastic including an upper member 5, a lower member 7 and diagonal intermediate members 9 joining the upper and lower members to provide a rigid, light weight structure. Great rigidity is required to maintain the panel flat when supported by joists or trusses that may be several feet apart and supporting a heavy user. Vertical intermediate members 10 define two rectangular channels 11. Two rectangular bars 12 are cemented into the rectangular channels 11 of a first half 14 of the panel with cement is indicated at 13. These fit snugly and removably into the rectangular channels 11 of the second half 15 of the panel and a spring-engaging locking pin 16 fits through holes 17 and 19 to prevent the halves 14 and 15 from pulling apart inadvertently. Apertures 20 provide convenient handles. Two rows of wheels 21 on axles 22 are mounted in wheel-receiving channels 23. A pair of grooves 24 on the sides of channel 23 engage strips 25 which have axle-receiving holes 26 (FIG. 3) to hold the axles 22 and wheels 21 in correct, closely-spaced position with an efficient and low labor cost assembly. Wheels having a diameter no greater than one and one-quarter inches and a spacing no greater than one and one-half inches on center have been found to perform effectively. These dimensions ensure that the upper edge of the ordinary roof truss will bear against at least two wheels to provide easy rolling and prevent trapping the truss between adjacent wheels. By providing a minimum length of fifty inches the device will span at least two ordinary joists or trusses at any time to prevent dropping below the top of the trusses. All the wheels in a half or segment are in a common plane to further provide smooth rolling simplicity and economy of construction. The upper surface 3 of the panel 2 may be provided with a high friction finish so that the creeper 1 is moved along with the torso when the torso is propelled by arms or legs. As best seen in FIG. 3 the short edges of the panel 2 terminate in sloping surface or ramp 27. This provides an inclined plane to help lift the forward end over an elevated joist or truss or other portion that is elevated above the wheel clearance provided. The sloping surface has been removed from FIG. 1 for illustrative purposes.

Figure 5:
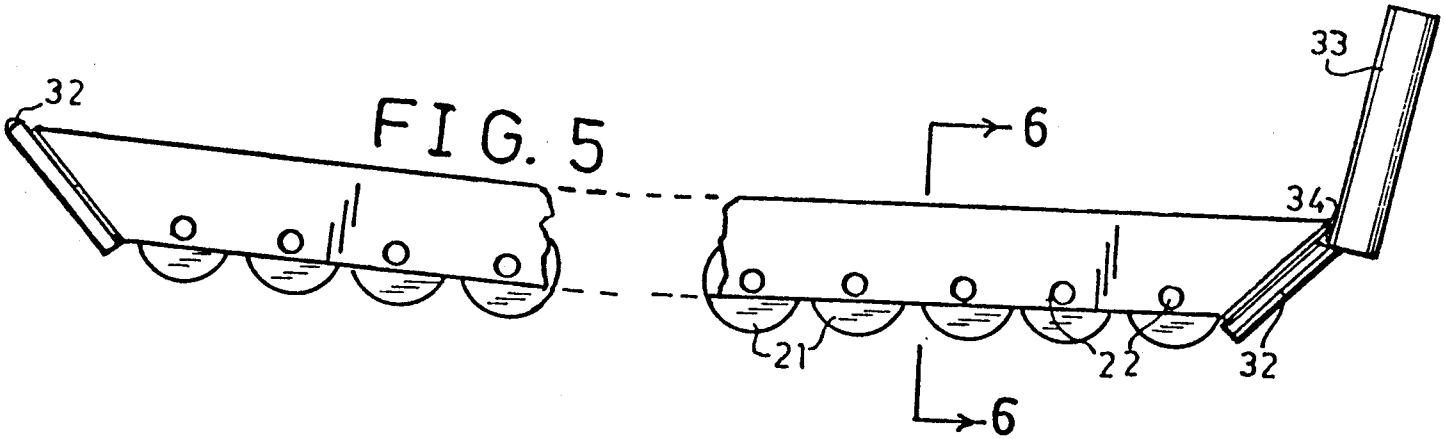
FIG. 5 is a side elevation view of an alternative embodiment of the creeper.

As shown in FIGS. 3 and 5, a plow 33 may be removably mounted by mounting clips 34 to the front surface. Clips 34 may be clips well known in the art and mounted on the plow 33, that engage U-shaped tube 32 that serves as a handle, for example. This plow pushes aside loose insulation as the platform is advanced. Alternatively, as shown in phantom in FIG. 5, a flat blade 36 with a curved top 38 may be attached to the front end at an angle to deflect downward those blankets of insulation that may be protruding upward between joists. The front face may be provided with a lubricous surface such as polyolefin or the entire blade may be formed of such material for easy sliding.

Figure 6:
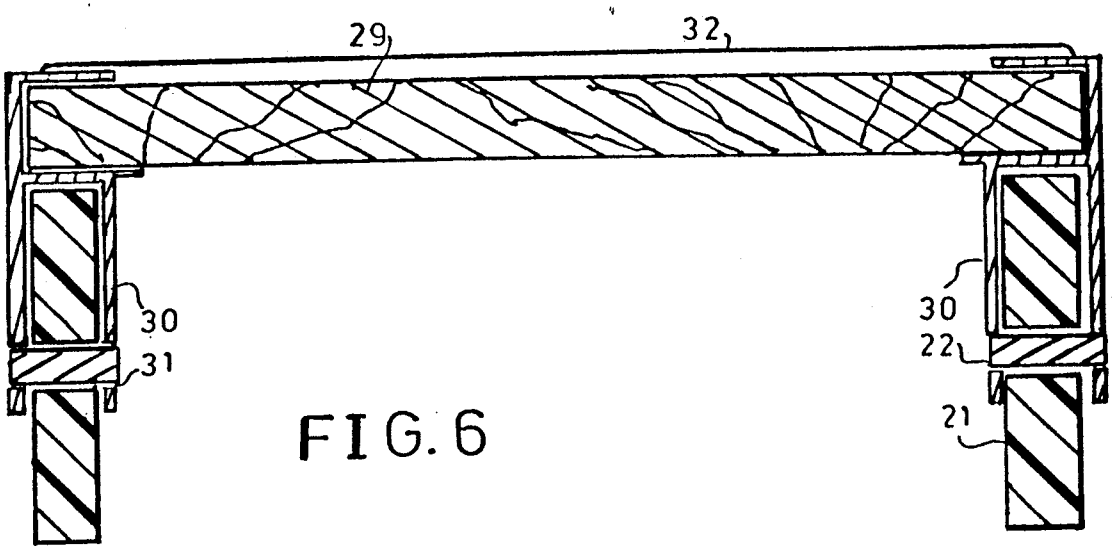
FIG. 6 is a cross sectional view through 6—6 of FIG. 5.
Figure 4:
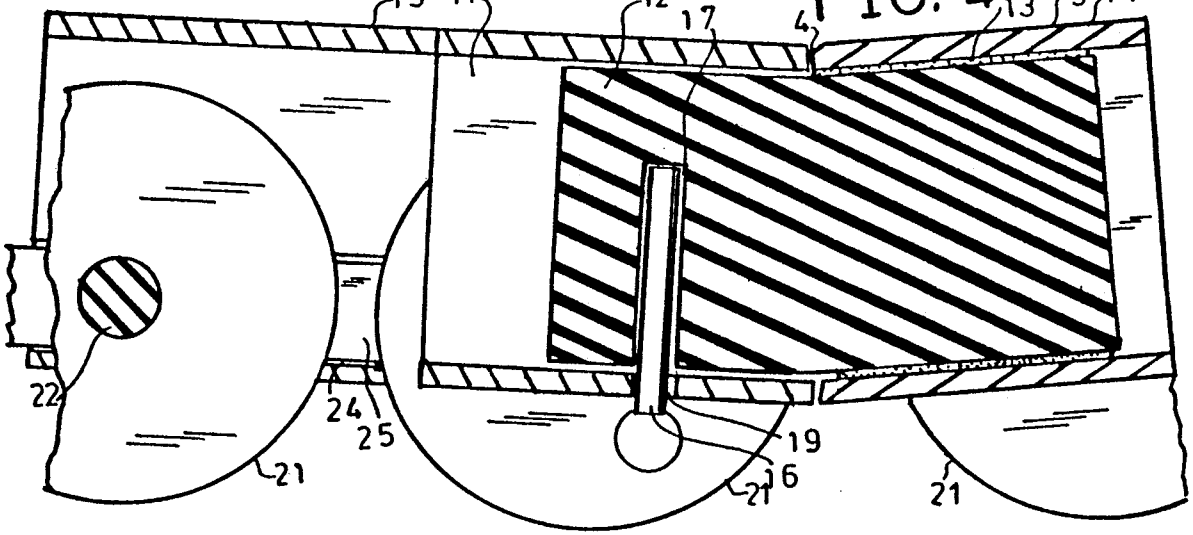
FIG. 4 is a cross sectional view through 4—4 of FIG. 3.

In the alternative embodiment illustrated in FIGS. 5 and 6, a plywood panel 29 (which will be wider than shown) is attached to a pair of profile extrusions 30 that provide a strong finished edge and support the wheels 21 on axles 22. A series of holes 31 in profile extrusions 30 engage the axles 22 and hold them securely in place. At each short edge, a U-shaped tube 32 serves as both a handle and the sloping ramp.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A rolling platform for supporting a user in a substantially horizontal position while providing rolling means for rolling over irregular surfaces while also providing means for manuevering on a smooth surface with only four wheels in contact with said smooth surface, said platform comprising:

(a) a long narrow panel means having a longitudinal axis, a top and bottom for supporting a user's weight while supported at locations separated by a distance of at least fourteen inches, said panel means having two long sides parallel to said longitudinal axis and two short sides connected to said long sides, said short sides terminating in rigidly connected sloping ends wherein said top extends over said bottom to facilitate sliding over elevated surfaces;

(b) two rows of wheels, each of said rows of wheels rotatably connected to one of said long sides, with said wheels extending below said bottom, wherein said rows of wheels are comprised of a first portion of wheels aligned in a first plane and a second portion of wheels aligned in a second plane, said first plane and said second plane arranged at a first angle of less than 180 degrees to one another wherein said platform is supported by two wheels, one from each row, from said first portion and two wheels, one from each row, from said second portion resting upon a plane surface for ease of maneuverability on said smooth surface said planes meeting at a line transverse to said longitudinal axis; and (c) in which said first portion of wheels are attached to a first segment of said platform and said second portion of wheels are attached to a second segment of said platform and said first segment and said second segment are removably attached to one another by a joint means for ease of handling, wherein said top of said panel means is comprised of two planar surfaces abutting one another at said first angle.

2. The rolling platform according to claim 1, in which said joint means includes at least one joining bar having a bend corresponding to said first angle, said bar removably joining said first segment to said second segment.

3. The rolling platform according to claim 1, including plow means with attaching means for removably attaching to one of said short sides for pushing aside loose material in a path of said rolling platform, said plow means having a smooth face extending away from said panel means, said smooth face arranged to force aside said loose material out of said path.

4. The rolling platform according to claim 2, including plow means with attaching means for removably attaching to one of said short sides for pushing aside loose material in a path of said rolling platform.

5. The rolling platform according to claim 2, including plow means for pushing down material in a path of said rolling platform, said plow means being removably and rigidly attachable to said sloping ends and having a low friction anterior surface.

6. A rolling platform for supporting a user in a substantially horizontal position while providing rolling means for rolling over irregular surfaces while also providing means for manuevering on a smooth surface with only four wheels in contact with said smooth surface, said platform comprising:

(a) a long narrow panel means having a longitudinal axis, a top and bottom for supporting a user's weight while supported at locations separated by a distance of at least fourteen inches, said panel means having two long sides parallel to said longitudinal axis and two short sides connected to said long sides, said short sides terminating in rigidly connected sloping ends wherein said top extends over said bottom to facilitate sliding over elevated surfaces;

(b) two rows of wheels, each of said rows of wheels rotatably connected to one of said long sides, with said wheels extending below said bottom, wherein said rows of wheels are comprised of a first portion of wheels aligned in a first plane and a second portion of wheels aligned in a second plane, said first plane and said second plane arranged at a first angle of less than 180 degrees to one another wherein said platform is supported by two wheels, one from each row, from said first portion and two wheels, one from each row, from said second portion resting upon a plane surface for ease of maneuverability on said smooth surface said planes meeting at a line transverse to said longitudinal axis; and (c) a plow means for pushing down material in a path of said rolling platform, said plow means being removably and rigidly attachable to said sloping ends and having a smooth, low-friction anterior surface, said anterior surface having an upper portion that extends beyond a lower portion to thereby push down said material.

* * * * *